US010446951B2

(12) United States Patent
Miedl

(10) Patent No.: US 10,446,951 B2
(45) Date of Patent: Oct. 15, 2019

(54) CONNECTOR ARRANGEMENT

(71) Applicant: Rosenberger Hochfrequenztechnik GmbH & Co. KG, Fridolfing (DE)

(72) Inventor: Thomas Miedl, Garching (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/032,115

(22) Filed: Jul. 11, 2018

(65) Prior Publication Data

US 2019/0020128 A1 Jan. 17, 2019

(30) Foreign Application Priority Data

Jul. 15, 2017 (DE) ..... 10 2017 006 767

(51) Int. Cl.

| | |
|---|---|
| ***H01R 9/05*** | (2006.01) |
| ***H01R 43/048*** | (2006.01) |
| ***H01R 4/18*** | (2006.01) |
| ***H01R 43/05*** | (2006.01) |

(52) U.S. Cl.

CPC ..... *H01R 9/0518* (2013.01); *H01R 4/183* (2013.01); *H01R 43/048* (2013.01); *H01R 43/05* (2013.01)

(58) Field of Classification Search

CPC .. H01R 9/0518; H01R 2103/00; H01R 4/646; H01R 4/24; H01R 4/183; H01R 43/048; H01R 43/05

USPC ..... 439/585, 99

See application file for complete search history.

(56) References Cited

U.S. PATENT DOCUMENTS

| | | | | |
|---|---|---|---|---|
| 8,366,483 | B2 * | 2/2013 | Hardy | H01R 9/0518 439/578 |
| 8,602,797 | B2 * | 12/2013 | Omae | H01R 13/6592 439/99 |
| 2001/0053633 | A1 * | 12/2001 | Konda | H01R 9/0518 439/625 |
| 2010/0297877 | A1 * | 11/2010 | Nakamura | H01R 9/0518 439/585 |
| 2013/0319761 | A1 * | 12/2013 | Furukawa | H01R 4/185 174/74 R |
| 2017/0271807 | A1 * | 9/2017 | Lane | H01R 9/05 |
| 2018/0123263 | A1 * | 5/2018 | Brantingham | H01R 9/0518 |

FOREIGN PATENT DOCUMENTS

| | | | |
|---|---|---|---|
| DE | 102017201969 | A1 | 11/2017 |
| EP | 3242359 | A1 | 11/2017 |

* cited by examiner

*Primary Examiner* — Gary F Paumen
(74) *Attorney, Agent, or Firm* — David P. Dickerson

(57) ABSTRACT

The present invention relates to a connector arrangement having a connector and a cable connected to the connector, wherein the cable has a sheath which extends as far as a stripped region, and a sleeve which is formed in the stripped region and is spaced apart from the sheath, such that the sheath and the sleeve form an annular groove, wherein the connector arrangement has an outer conductor contact which extends from the connector to the sheath of the cable and has a radial indentation at the location of the annular groove. The present invention also relates to a method for the assembly thereof.

18 Claims, 4 Drawing Sheets

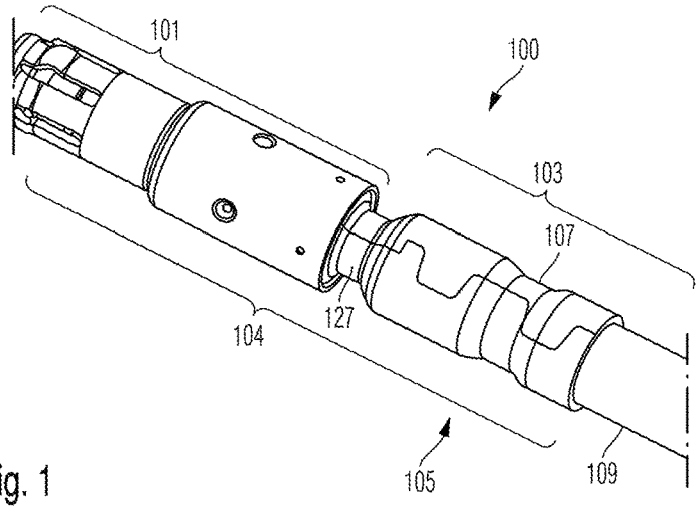
Fig. 1
Fig. 1A
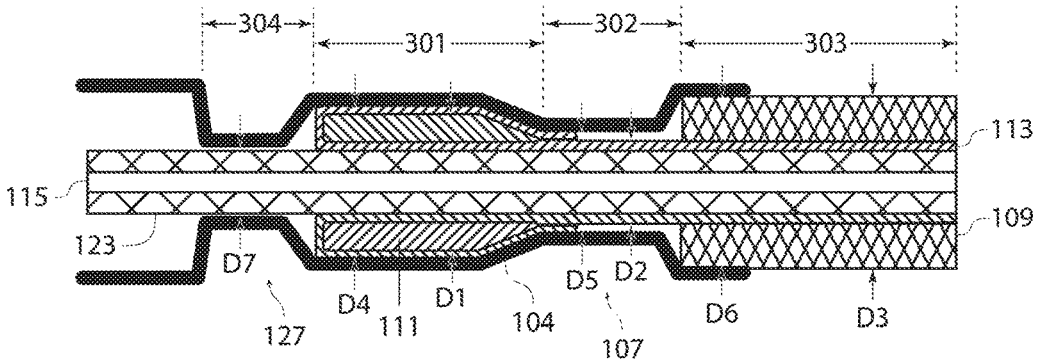
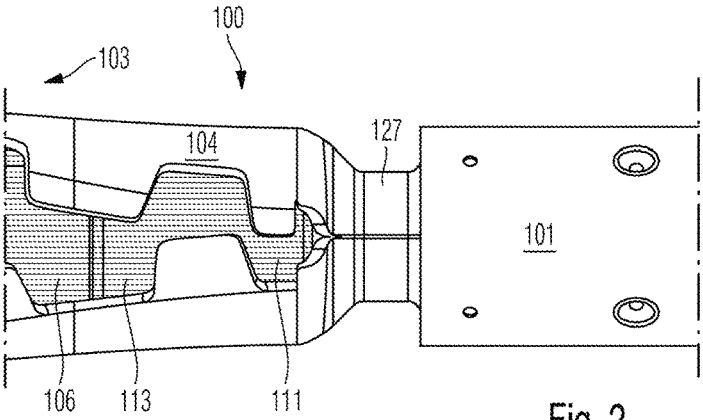
Fig. 2

CONNECTOR ARRANGEMENT

FIELD OF THE INVENTION

The present invention relates to a connector arrangement having a cable and a connector.

TECHNICAL BACKGROUND

In order to connect cables to connectors, it is known to press the cable and the connector together in a connecting region. In the process, the force with which the cable is pressed together with the connector affects the mechanical holding force between the cable and the connector. A problem here is that pressing together is associated with deformation of the cable and of the connector. This deformation has a disadvantageous effect on the electrical properties of a connector arrangement.

EP 3 242 359 A1 shows a connector arrangement having a connector and a cable connected to the connector, wherein the cable has at least one indentation in a connecting region in which the cable is connected to the connector, wherein the connector has an outer conductor contact which extends from the connector as far as the connecting region of the cable and is formed in a manner corresponding to the surface of the connecting region with the indentation, wherein the cable has a sheath which extends as far as a stripped region, and a sleeve which is formed in the stripped region and is spaced apart from the sheath such that the sheath and the sleeve form an indentation of the cable, wherein the outer conductor contact extends as far as the sheath of the cable and has, at the location of the indentation of the cable, an indentation which corresponds to this indentation of the cable and increases the holding force of the outer conductor contact on the cable, wherein the cable has an outer conductor and an inner conductor which are insulated by the sheath, wherein the outer conductor is wrapped over the sleeve in the connecting region.

Thus, the outer conductor, specifically a braided shield, can change its structure and/or position following the production of a connection between the connector and the cable.

This is a state worthy of improvement.

SUMMARY OF THE INVENTION

In light of this background, the present invention provides a connector arrangement having an increased holding force between the cable and the connector and improved electrical properties of the connector arrangement.

Loosely speaking, the present disclosure teaches an increase of the holding force of a connector on a cable by the cable having a stepped surface in an end region for joining to a connector, and by an outer conductor contact of the connector being formed in a manner corresponding to the stepped surface in this connecting region.

The present disclosure teaches that, in some embodiments, the cable has a sheath which extends as far as a stripped region, and a sleeve which is formed in the stripped region and is spaced apart from the sheath such that the sheath and the sleeve form an indentation of the cable.

This is particularly advantageous, since cables generally have a sheath and connector arrangements generally have a sleeve. Accordingly, no additional elements need to be added to the connector arrangement, and so, on account of the assembly process, no additional costs arise and said connector arrangement has to be adapted only slightly.

It goes without saying that the indentation can be interrupted by a protuberance. As protuberance, it is possible to provide for example a plastics ring which encloses the cable in the region of the indentation. The use of plastic is particularly advantageous, since plastic does not affect the electrical properties of the connector arrangement.

In some embodiments, the outer conductor contact extends as far as the sheath of the cable and has, at the location of the indentation of the cable, an indentation which corresponds to this indentation of the cable and increases the holding force of the outer conductor contact on the cable.

This embodiment is also particularly easy to implement in an assembly process.

Alternatively, the outer conductor contact can have an additional protuberance.

In some embodiments, the cable has an outer conductor and an inner conductor which are insulated by a sheath, wherein the outer conductor is wrapped over the sleeve in the connecting region.

In some embodiments, the outer conductor of the cable is fastened, in particular clamped in place, by the outer conductor contact of the connector arrangement in the region between the sleeve and the indentation of the outer conductor contact. In this way, the outer conductor of the cable can additionally be fastened without an additional assembly step being necessary for this purpose.

In this way, the force with which a cable is pressed together with a connector can be reduced, since the holding force is already increased by the correspondingly stepped surfaces of the cable and of the connector. This has a positive effect on the electrical properties of the connector arrangement, since pressing together is basically detrimental to the electrical properties of a connector arrangement.

Advantageous configurations and developments are apparent from the dependent claims and from the description with reference to the figures of the drawing.

It goes without saying that the features mentioned above and those still to be explained below are usable not only in the combination specified in each case but also in other combinations or on their own, without departing from the scope of the present invention.

In some embodiments, the cable has, in the connecting region, at least one plastics ring which forms a protuberance, and the outer conductor contact has a protuberance corresponding to the plastics ring.

It goes without saying that the term "ring" also encompasses a partially circumferential, for example C-shaped enclosure of the cable, provided that the enclosure exhibits a sufficient holding force on the cable.

In some embodiments, the plastics ring is manufactured from the same material as the cable sheath. As a result, material can be saved, since excess sheath material accrues when the cable is stripped.

Alternatively, the plastics ring can also be manufactured from a more rigid plastic. This is particularly advantageous for a C-shaped enclosure, since the latter is particularly easy to clip-fasten on the cable.

Depending on the structure of the connector arrangement, it may be advantageous to coat the plastics ring on its inner side with electrically conductive material. As a result, it may be possible for electrical properties of the connector arrangement to be improved.

Depending on the field of application of the connector arrangement, the cable has an outer conductor which is in the form of a braided shield. This ensures sufficient electromagnetic shielding of the cable. The wrapping of the outer conductor of the cable about the sleeve ensures that the outer conductor is fastened to the sleeve and prevents said outer conductor from slipping.

In some embodiments, the sleeve has a holding means which exerts a radially inwardly directed force from the sleeve onto the cable. In this way, the sleeve can be additionally secured against slipping on the cable.

In some embodiments, the holding means is formed as a partially circumferential protrusion of the sleeve, in particular at a sheath-side end of the sleeve. In this way, the holding force of the sleeve can be increased particularly easily. A particular advantage of this is that a partially circumferential narrowing or a partially circumferential inward pressure has only a slight effect on the impedance of the connector arrangement compared with a fully circumferential narrowing or fully circumferential inward pressure, but already ensures a noticeable increase in the mechanical holding force of the sleeve.

In some embodiments, the connector is crimped to the cable at the indentation and/or protuberance. This is a connecting technique which ensures a sufficient holding force.

In some embodiments, a sheath is crimped to the outer conductor contact. In this way, the mechanical holding force is additionally increased.

The above configurations and developments can be combined with one another as desired, where appropriate. Further possible configurations, developments and implementations of the invention also encompass combinations, not explicitly mentioned, of features of the invention that are described above or in the following text with regard to the exemplary embodiments. In particular, a person skilled in the art will also add individual aspects as improvements or additions to the particular basic form of the present invention.

BRIEF DESCRIPTION OF THE DRAWINGS

The present invention is explained in more detail in the following text on the basis of the exemplary embodiments shown in the schematic figures of the drawing, in which:

FIG. 1 shows a schematic perspective view of one embodiment of a connector arrangement according to the present disclosure;

FIG. 1A shows a schematic cross-sectional view of an embodiment of a connector arrangement according to the present disclosure;

FIG. 2 shows a schematic perspective view of one embodiment of a connector 10 arrangement according to the present disclosure;

Figure 3:
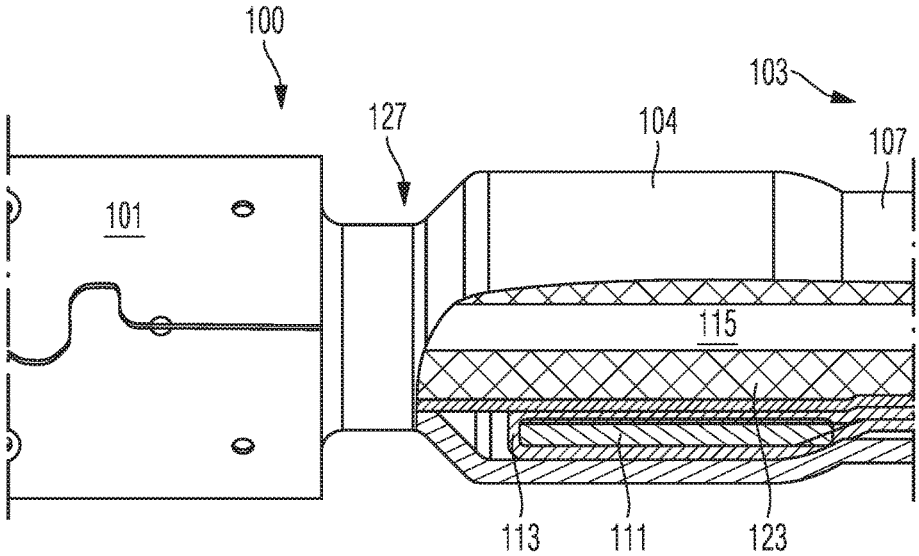
FIG. 3 shows a schematic perspective view of one embodiment of a connector arrangement according to the present disclosure.

The accompanying figures of the drawing are intended to provide further understanding of the embodiments of the invention. They illustrate embodiments and serve, in conjunction with the description, to explain principles and concepts of the invention. Other embodiments and many of the mentioned advantages will become apparent from the drawings. The elements of the drawings are not necessarily shown true to scale in relation to one another.

In the figures of the drawing, identical, functionally identical and identically acting elements, features and components—unless stated otherwise—are each provided with the same reference signs.

In the following text, the figures are described in a coherent and comprehensive manner.

DESCRIPTION OF EXEMPLARY EMBODIMENTS

FIG. 1 shows an embodiment of a connector arrangement 100 according to the present disclosure, having a connector 101 and a cable 103. The connector 101 has an outer conductor contact 104, which has been placed on one end of the cable 103. The cable 103 has been stripped, such that the outer conductor contact 104 of the connector 101 still extends as far as a starting region of the sheath 109 of the cable 103.

The outer conductor contact 104 has the indentation 107 in the cable-side end region. Located under the indentation 107 is an indentation 106 of the cable that corresponds to the indentation 107. The outer conductor contact 104 is clamped to the cable 103 at the indentation 107, such that the outer conductor contact 104 is fastened to the cable 103 sufficiently tightly. On account of the indentation 107 or 106, the force with which the outer conductor contact 104 is pressed together with the cable 103 can be reduced considerably, since the stepped surface of the cable 103 or of the outer conductor contact 104 already ensures a sufficient holding force.

FIG. 1A shows a schematic cross-sectional view of an embodiment of a connector arrangement according to the present disclosure. FIG. 1A is provided solely for the purpose of designating, certain segments of the cable and certain diameters with reference signs. As such, FIG. 1A is not to be interpreted as teaching any structural features of the invention not discernible from the other figures.

Specifically, FIG. 1A depicts a first segment 301 of cable 103 where sleeve 311 is situated, a second segment 302 of cable 103 that lacks sheathing 109 radially outward of outer conductor 113, a third segment 303 of cable 103 that comprises sheathing 109 radially outward of outer conductor 113, and a segment 304 of outer conductor contact 104 adjacent to an end of sleeve 111 distal to second segment 302.

FIG. 1A moreover depicts a diameter D1 of an outer circumference of sleeve 111, a diameter D2 of an outer circumference of second segment 302, a diameter D3 of an outer circumference of third segment 303, an inner diameter D4 of outer conductor contact 101 in a plane trough sleeve 111, an inner diameter D5 of outer conductor contact 104 in a plane through second segment 302, an inner diameter D1 of outer conductor contact 104 in a plane through third segment 303, and an inner diameter D7 of outer conductor contact 104 in segment 304 of outer conductor contact 104 adjacent to an end of sleeve 111 distal to second segment 302.

FIG. 2 illustrates the connector arrangement 100 during the assembly process, since, although the outer conductor contact 104 has already received the cable 103, the outer conductor contact 104 has not yet been closed. Under the outer conductor contact 104, the outer conductor 113 of the cable can be seen. The outer conductor 113 is in the form of a braided shield. Arranged under the outer conductor 113 is the sleeve 111, over which the outer conductor 113 is wrapped or pulled. The sleeve 111 delimits the indentation 106 of the cable.

Located between the cable 103 and the connector 101 is a narrowing 127. The cable 103 is clamped in place and firmly held by the funnel-shaped region of the narrowing 127.

The point at which the outer conductor of the connector arrangement 100 transitions from the braided shield 113 or outer conductor of the cable 103 to the outer conductor contact 104 of the connector is apparent from FIG. 3.

Also illustrated is the fact that the outer conductor 113 of the cable 103 extends beneath the supporting sleeve 111 and, at a front edge of the supporting sleeve 111, is wrapped over the latter and is held firmly at the rear edge of the supporting sleeve 111 by the outer conductor contact 104 and the indentation 107.

Figure 4:
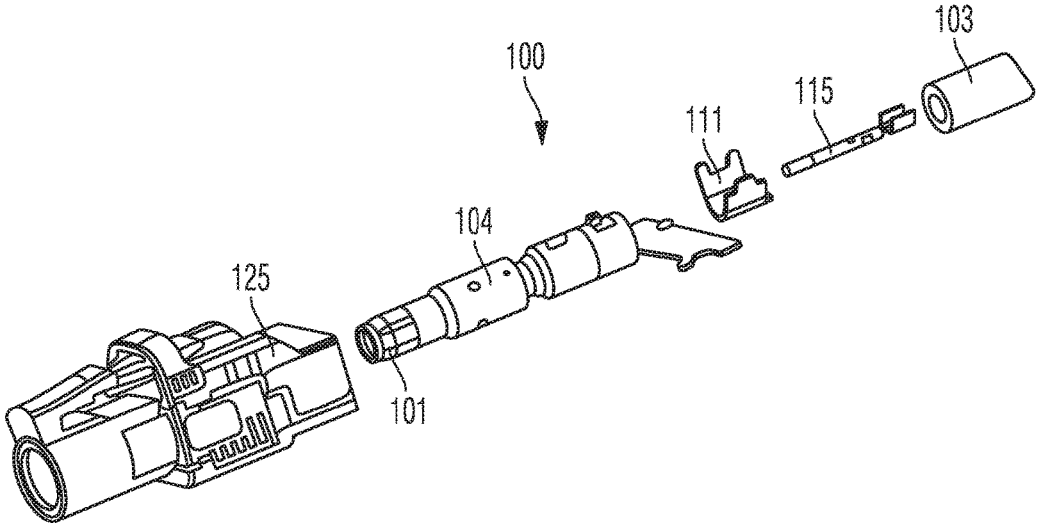
FIG. 4 shows a schematic exploded view of one embodiment of a connector arrangement according to the present disclosure.

FIG. 4 shows a schematic exploded view of a connector arrangement 100 according to the present disclosure, having a cable 103 and a connector 101 which is inserted into a housing 125. In the assembled state, the inner conductor contact 115 is mounted at an interface-side end of the connector 101. Once the cable 103 has been stripped at one end, the sleeve 111 is pushed onto the stripped end.

Figure 5:
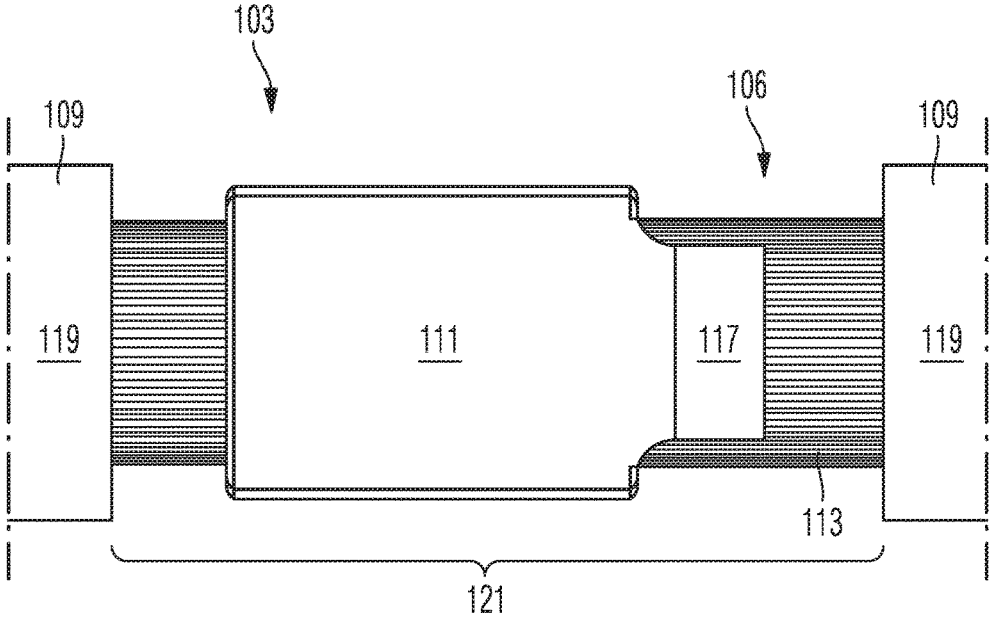
FIG. 5 shows a schematic view of one embodiment of a connector arrangement according to the present disclosure.
Figure 6:
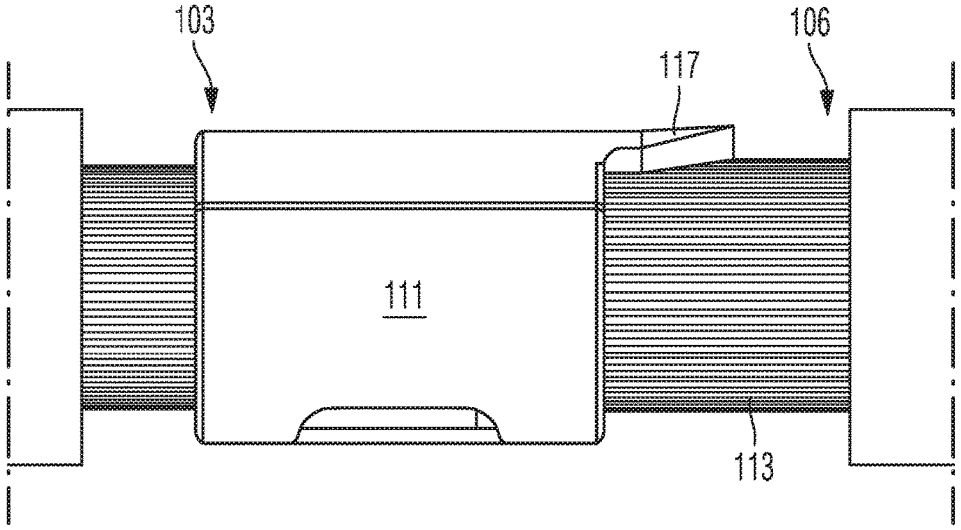
FIG. 6 shows a schematic view of one embodiment of a connector arrangement according to the present disclosure.

FIGS. 5 and 6 show a schematic side view of a detail of a cable 103 according to the present disclosure. The cable has a stripped region 121 in which the sheath 109 has been removed from the cable 103. Once the cable 103 has been stripped, the sleeve 111 has been pushed onto the stripped region 121. The sleeve 111 comprises a holding means 117 which applies a radially inwardly acting force to the cable 103 and thus prevents the sleeve 111 from slipping on the cable 103. The holding means 117 is formed in a partially circumferential manner and is designed in this regard such that a jump in diameter of the holding means 117 with respect to the sleeve body has as little effect as possible on the impedance of the connector arrangement. At the connector-side end of the cable, an annular sheath portion is attached in order to prevent individual strands or parts of the braided shield of the cable 103 from fraying.

Figure 7:
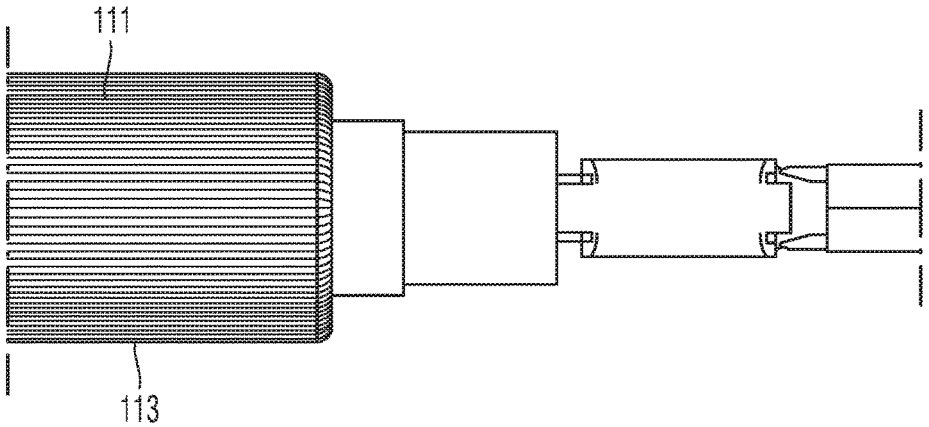
FIG. 7 shows a schematic view of one embodiment of a connector arrangement according to the present disclosure.

FIG. 7 shows a schematic view of a cable, ready to be assembled, which is equipped with an inner conductor contact and a sleeve.

Figure 8:
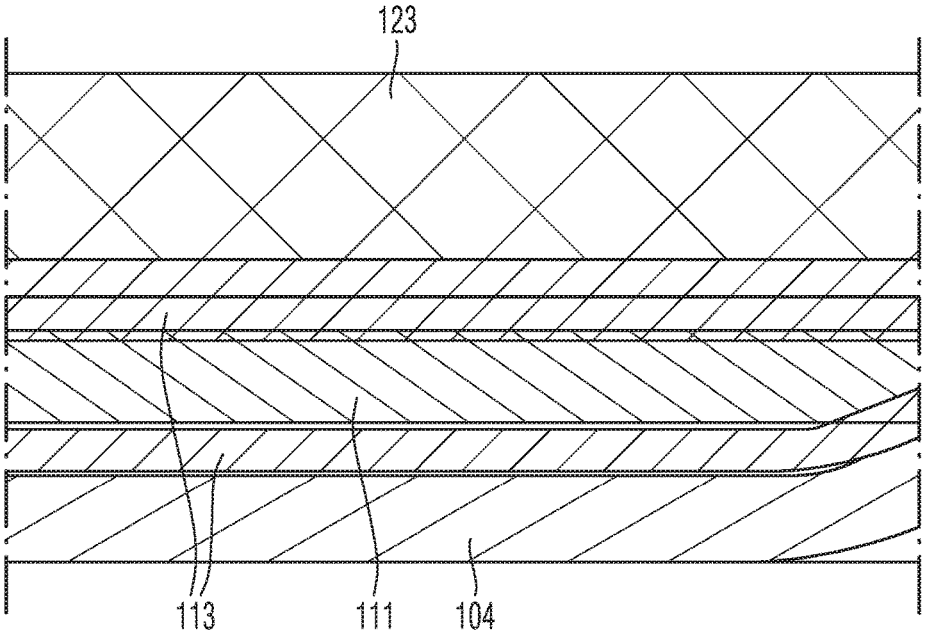
FIG. 8 shows a schematic view of one embodiment of a connector arrangement according to the present disclosure.

FIG. 8 shows the layer-wise structure of a connector arrangement according to the present disclosure in the vicinity of the indentation 106. It can be seen here that only the outer conductor contact 104 and the upper layer of the outer conductor 113 which is located on the sleeve 111 are deformed inwards. In this way, the electrical properties of the remaining elements of the connector arrangement are largely retained.

Although the present invention has been described above in full on the basis of preferred exemplary embodiments, it is not limited thereto but able to be modified in many ways.

The present disclosure may be summarized as disclosing, inter cilia, the following Embodiments.

Embodiment 1

A connector arrangement (100) having a connector (101) and a cable (103) connected to the connector, wherein the cable has at least one indentation in a connecting region in which the cable is connected to the connector, wherein the connector has an outer conductor contact (104) which extends from the connector to the connecting region (105) of the cable and is formed in a manner corresponding to the surface of the connecting region with the indentation (106), wherein the cable has a sheath (109) which extends as far as a stripped region, and a sleeve (111) which is formed in the stripped region and is spaced apart from the sheath, such that the sheath and the sleeve form an indentation of the cable, wherein the outer conductor contact extends as far as the sheath of the cable and has, at the location of the indentation (106) of the cable, an indentation (107) which corresponds to this indentation of the cable and increases the holding force of the outer conductor contact on the cable, wherein the cable has an outer conductor (113) and an inner conductor which are insulated by the sheath (109), wherein the outer conductor is wrapped over the sleeve in the connecting region, and wherein the outer conductor of the cable is fastened by the outer conductor contact of the connector arrangement in the region of the indentation of the outer conductor contact.

Embodiment 2

The connector arrangement according to Embodiment 1, wherein the cable has, in the connecting region, at least one plastics ring which forms a protuberance, and the outer conductor contact has a protuberance corresponding to the plastics ring.

Embodiment 3

The connector arrangement according to Embodiment 1 or 2, wherein the sleeve has a holding means (117) which exerts a radially inwardly directed force from the sleeve onto the cable.

Embodiment 4

The connector arrangement according to Embodiment 3, wherein the holding means is formed as a partially circumferential protrusion of the sleeve.

Embodiment 5

The connector arrangement according to any one of Embodiments 1-4, wherein the connector is crimped to the cable at the indentation.

Embodiment 6

The connector arrangement according to Embodiment 5, wherein a sheath is crimped to the outer conductor contact.

Embodiment 7

An assembly method for a connector arrangement (100) with a connector (101) and a cable (103) connected to the connector, comprising the following steps of:

providing the cable having a sheath (109);

providing a connector to be connected to the cable;

stripping the cable such that a sheathed region (119) and a stripped region (121) of the cable are produced;

attaching a sleeve in the stripped region of the cable such that the sleeve, together with the sheath, forms an indentation (106) of the cable;

indenting an outer conductor contact of the connector at the indentation such that the outer conductor contact has, at the indentation of the cable, an indentation (107) which increases the holding force of the outer conductor contact on the cable.

LIST OF REFERENCE SIGNS

100 Connector arrangement
101 Connector
103 Cable
104 Outer conductor contact
105 Connecting region
106 Indentation
107 Indentation
109 Sheath
111 Sleeve
113 Outer conductor
115 Inner conductor contact
117 Holding means
119 Sheathed region
121 Stripped region
123 Insulating part
125 Housing
127 Narrowing

The invention claimed is:

1. A cable connector assembly, comprising:

a coaxial cable comprising an inner conductor, an outer conductor, and an insulator that insulates said inner conductor from said outer conductor; and a sleeve, wherein each of said outer conductor and said insulator extend through a lumen of said sleeve, a portion of said outer conductor is folded to substantially parallel to said inner conductor and radially outward of said sleeve, said sleeve is situated on a first segment of said coaxial cable, a second segment of said coaxial cable lacks sheathing radially outward of said outer conductor, a third segment of said coaxial cable comprises sheathing radially outward of said outer conductor, and said second segment of said coaxial cable is located intermediate said first segment and said third segment.

2. The cable connector assembly of claim 1, wherein:

a diameter of an outer circumference of said second segment is less than a diameter of an outer circumference of said third segment and less than a diameter of an outer circumference of said sleeve.

3. The cable connector assembly of claim 1, comprising:

an outer conductor contact having a first inner diameter in a plane through said sleeve and a second inner diameter in a plane through said second segment, wherein said second inner diameter is smaller than said first inner diameter.

4. The cable connector assembly of claim 3, wherein:

said outer conductor contact has a third inner diameter in a plane through said third segment, and said second inner diameter is smaller than said third inner diameter.

5. The cable connector assembly of claim 3, wherein:

said outer conductor contact has a fourth inner diameter in a segment of said outer conductor contact adjacent to an end of said sleeve distal to said second segment, and said fourth inner diameter is smaller than said first inner diameter.

6. The cable connector assembly of claim 3, wherein:

said outer conductor contact electrically contacts said outer conductor at at least one of said second segment and said portion radially outward of said sleeve.

7. The cable connector assembly of claim 3, wherein:

said outer conductor contact comprises a non-linear seam that extends an entire length of said outer conductor contact.

8. The cable connector assembly of claim 7, wherein:

said seam is a toothed seam.

9. The cable connector assembly of claim 3, wherein:

said outer conductor contact is crimpable from an open, generally C-shaped configuration to a closed, tubular configuration.

10. The cable connector assembly of claim 3, wherein:

said first inner diameter corresponds to a diameter of an outer circumference of said portion of said outer conductor radially outward of said sleeve, and said second inner diameter corresponds to a diameter of an outer circumference of said second segment of said coaxial cable.

11. The cable connector assembly of claim 4, wherein:

said third inner diameter corresponds to a diameter of an outer circumference of said third segment of said coaxial cable.

12. A connector assembly for a coaxial cable comprising an inner conductor and an outer conductor, said connector assembly comprising:

a sleeve; and an outer conductor contact crimped from an open, generally C-shaped configuration to a closed, tubular configuration, wherein said outer conductor contact comprises a first segment having a first inner diameter that corresponds to an outer circumference of said sleeve including tolerance for a portion of said outer conductor folded to extend substantially parallel to said inner conductor and radially outward of said sleeve, said outer conductor contact comprises a second segment having a second inner diameter that is smaller than said first inner diameter, said outer conductor contact comprises a third segment having a third inner diameter that is larger than said second inner diameter, and said second segment is located intermediate said first segment and said third segment.

13. A cable connector assembly method, comprising the steps of:

removing, from a coaxial cable that comprises an inner conductor, an outer conductor, an insulator that insulates said inner conductor from said outer conductor, and sheathing radially outward of said outer conductor, a length of said sheathing from an end portion of said coaxial cable, providing a sleeve at said end portion, such that each of said outer conductor and said insulator extend through a lumen of said sleeve, folding a portion of said outer conductor to extend substantially parallel to said inner conductor and radially outward of said sleeve, and crimping an outer conductor contact onto an outer circumference of said end portion, wherein said outer conductor contact has a first inner diameter in a plane through said sleeve and a second inner diameter in a plane through a segment of said end portion intermediate said sleeve and a segment of said coaxial cable comprising said sheathing, and said second inner diameter is smaller than said first inner diameter.

14. The cable connector assembly method of claim 13, wherein:

said crimping comprises crimping said outer conductor contact onto an outer circumference of said segment of said coaxial cable comprising said sheathing, wherein said outer conductor contact has a third inner diameter in a plane through said segment of said coaxial cable comprising said sheathing, and said second inner diameter is smaller than said third inner diameter.

15. The cable connector assembly method of claim 13, wherein:

said outer conductor contact has a fourth inner diameter at a segment of said outer conductor contact adjacent to an end of said sleeve distal to said segment of said coaxial cable comprising said sheathing, and said fourth inner diameter is smaller than said first inner diameter.

16. The cable connector assembly method of claim 13, wherein:

said outer conductor contact comprises a non-linear seam that extends an entire length of said outer conductor contact.

17. The cable connector assembly method of claim 16, wherein:

said seam is a toothed seam.

18. The cable connector assembly method of claim 13, wherein:

said outer conductor contact is crimpable from an open, generally C-shaped configuration to closed, tubular configuration.

* * * * *